US005188515A

United States Patent [19]

Horn

[11] Patent Number: 5,188,515

[45] Date of Patent: Feb. 23, 1993

[54] DIAPHRAGM FOR AN HYDRAULICALLY DRIVEN DIAPHRAGM PUMP

[75] Inventor: Waldemar Horn, Wimsheim, Fed. Rep. of Germany

[73] Assignee: Lewa Herbert Ott GmbH & Co., Fed. Rep. of Germany

[21] Appl. No.: 709,648

[22] Filed: Jun. 3, 1991

[30] Foreign Application Priority Data

Jun. 8, 1990 [DE] Fed. Rep. of Germany ..... 4018464

[51] Int. Cl.[5] ..... F04B 21/00

[52] U.S. Cl. ..... 417/63

[58] Field of Search ..... 417/63, 412, 413

[56] References Cited

U.S. PATENT DOCUMENTS 3,605,566 9/1971 Vetter ..... 417/63

*Primary Examiner*—Richard A. Bertsch
*Assistant Examiner*—Charles G. Freay
*Attorney, Agent, or Firm*—Bierman and Muserlian

[57] ABSTRACT

In a diaphragm 1 for an hydraulically driven diaphragm pump provided with a device 22 for the indication of a diaphragm rupture wherein the diaphragm 1 is clamped at the margin between the pump housing 2 and pump cover 3 and comprises at least two individual layers 20, 21 between which a diaphragm interspace 19 is formed which is connected with the indicator device 22, the implementation is selected so that the individual diaphragm layers 20, 21 for the purely mechanical coupling during the pressure stroke as well as during the intake stroke are connected through a multiplicity of connecting areas 27 or 30 with the formation of interspaced free areas or free spaces.

12 Claims, 4 Drawing Sheets

DIAPHRAGM FOR AN HYDRAULICALLY DRIVEN DIAPHRAGM PUMP

STATE OF THE ART

Figure 1:
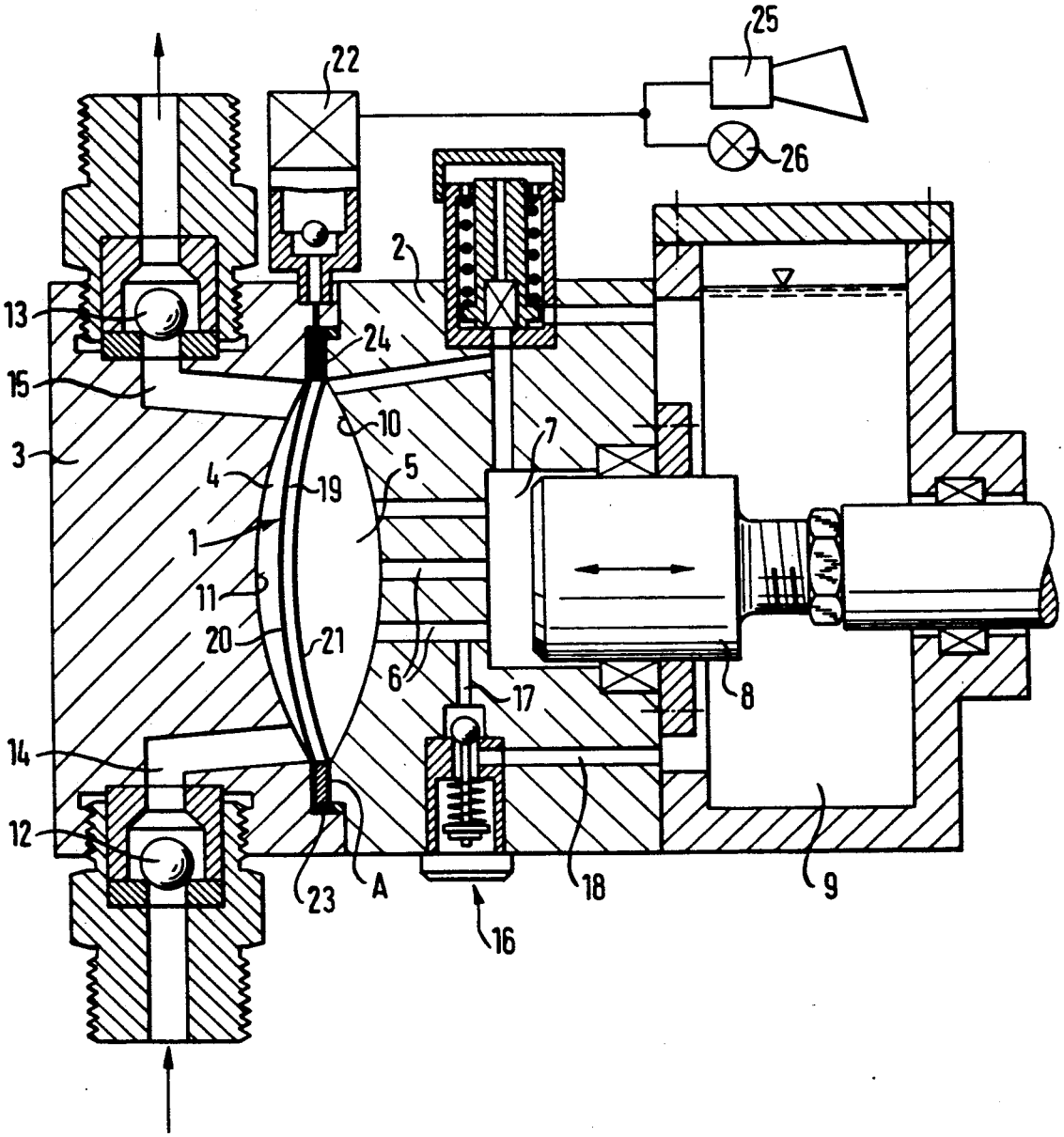

With diaphragm pumps of this type which for reasons of safety are equipped with a diaphragm rupture signaling system, the diaphragm is customarily made of two or more individual layers to be informed as rapidly as possible in the event of a diaphragm rupture and to prevent an exchange of pumped and hydraulic fluid by taking appropriate measures. The rapid signaling of the diaphragm rupture is made possible herein through a connection of the diaphragm interspace formed between the individual diaphragm layers with an indicator device.

To prevent especially during the intake stroke the undesired separation of the individual layers of the diaphragm from each other, it is required to dispose the individual layers of the diaphragm in a suitable manner and to couple them to each other. In this connection, it is already known (DE-P 710,320) to form the diaphragm of three individual layers which are loosely lying one on the other. However, this has the disadvantage that during the intake operation, an unsatisfactory operating reliability is given since the individual layers of the diaphragm can become detached from one another.

To eliminate this disadvantage, it is already known (DE-AS 1,226,740) to evacuate this diaphragm interspace formed between two individual layers. This measure does insure a certain coupling of the diaphragm layers particularly during the intake operation. However, the disadvantage is that a large expenditure in terms of equipment is required because inter alia a vacuum pump must be provided and be operated practically continuously to keep the diaphragm interspace evacuated and to ensure the coupling.

The above stated disadvantage is effectively avoided in a further known diaphragm arrangement (DE-PS 1,800,018) in which the diaphragm interspace formed between the individual layers of the diaphragm is filled with an hydraulic medium wherein the diaphragm interspace is closed toward the outside through a check valve in such a way that the hydraulic medium can only penetrate toward the outside. A perfect hydraulic coupling of the diaphragm layers in the intake stroke obtains hereby wherein simultaneously a mechanical coupling in the pressure stroke is present. Such an implementation, however, requires a perfect filling of the diaphragm interspace with hydraulic medium. Moreover, the formation of gas can occur in the diaphragm interspace with large suction height leading to a decrease of the performance of the pump.

OBJECTS OF THE INVENTION

It is an object of the invention to provide a diaphragm of this type for an hydraulically driven diaphragm pump so that perfect reliable coupling of the diaphragm layers is achieved with simple means during the pressure as well as the intake stroke and simultaneously a tear formation in a diaphragm layer can be reliably signalled immediately.

This and other objects and advantages of the invention will become obvious from the following detailed description.

THE INVENTION

The diaphragm of the invention for an hydraulically driven diaphragm pump provided with a device for indicating diaphragm rupture wherein the diaphragm clamped at the margin between pump housing and pump cover comprises at least two individual layers between which is formed a diaphragm interspace connected with the indicator device, is characterized in that the individual diaphragm layers (20, 21) for the purely mechanical coupling during the pressure stroke as well as also during the intake stroke are connected with each other through a multiplicity of connecting areas (27, 30) with the formation of interspaced free areas or free spaces, respectively.

The diaphragm of the invention is based on the concept of connecting the individual diaphragm layers for the pure mechanical coupling in the pressure stroke as well as also in the intake stroke via a multiplicity of connecting areas with the formation of free areas or free spaces disposed in between them. To be able to achieve this in practice, it would indeed be conceivable to connect the diaphragm layers with each other by adhesion, but the layer of adhesive means disposed between the diaphragm layers under great pressure would be subjected to shearing forces which would lead to premature failure of the connection.

Alternatively, a preferred embodiment of the invention provides that the diaphragm layers are made of synthetic materials, especially fluoropolymers, and that the connecting areas are formed by welding together the diaphragm layers. Such fluoropolymers allow a compact and cost-effective structural shape of the pump and preferably the fluoropolymer is polytetrafluoroethylene (PTFE) which is distinguished by a nearly complete resistance against all media as well as by good flexibility.

Because of its high melting viscosity, pure PTFE can be welded only with difficulty, but this fact can be effectively circumvented thereby that for example as material for the diaphragm layers, modified types of PTFE are used which are known from the sales information VM 423, p. 11 of Hoechst AG, Frankfurt, and which have good welding characteristics. The welding process herein takes place at approximately 360° C. to 390° C.

Alternatively, it is also possible to provide one or several thin intermediate layers of copolymers with 90 to 99.5% by weight of PTFE and 0.5 to 10% by weight of perfluoroalkyl perfluorovinylether between the diaphragm layers. Herein, the welded connection is generated under pressure and heat wherein the temperature is approximately 360° C. to 390° C. i.e. above the melting point of PFTE (325° C). With welded connections of this type, weld factors of up to 1.0 can be achieved which means that the strength of the welding site forming the particular connecting areas corresponds to that of the basic material.

It is of advantage if the connecting areas are made so as to be as small as possible while forming the largest possible free areas or free spaces. Herein it is simultaneously recommended to design the implementation in such a way that the connecting areas have the least possible distance between one another. Furthermore, it is of advantage if the connecting areas are distributed largely uniformly.

It is within the scope of the invention to implement the connecting areas either as radially extending connecting strips or as connecting points. In any case, the individual connecting sites or areas are dimensioned with respect to their diameter so that, on the one hand, a secure connection is formed and that, on the other hand, diaphragm tears developing within welded connecting sites spread to the area outside of the welded connecting sites before a tear running through all layers is generated whereby faultless diaphragm rupture signaling is ensured.

In the case of the implementation of the connecting sites as weld points, good results can be achieved if the weld points have a diameter of 3 to 5 mm. The distance between the connecting points which preferably should be a minimum distance should be selected so that the diaphragm layers between the connecting points do not separate from each other significantly during the intake stroke, since with too great a distance, the performance of the pump would decrease with increasing suction height. It has been found that a favorable distance between the welded connecting points is in the range of approximately 10 to 15 mm.

Further advantages result if in the diaphragm of the invention, the customary one margin clamp-in zone having a displacement zone and a flexure or transition zone actively effecting the transport, the connecting areas are disposed exclusively in the displacement zone so that the displacement zone of the diaphragm has at the margin an encompassing connection-free area, for example of 5 to 10 mm width.

According to a further embodiment of the invention, the outer diaphragm layers can be mechanically connected with one another by disposing an intermediate layer between them. Herein the arrangement is made in such a way that the intermediate layer comprises either a separating woven fabric or a separating nonwoven fabric in which the particular provided interspaces between the diaphragm layers together with the free spaces form the diaphragm interspace connected with the indicator device. Alternatively, it is also possible to use as intermediate layer one comprised of the material of the outer diaphragm layers and provided with slits. In that case, the slits together with the free spaces between the diaphragm layers form herein the diaphragm interspace.

In any case, due to the diaphragm of the invention, simple handling during diaphragm mounting as well as during diaphragm replacement is achieved since the diaphragm as compound part is very simple to handle and does not require separate expenditures of any kind to be readied for operation. The purely mechanical coupling provided between the diaphragm layers over the long term functions during intake stroke without disturbances, and specifically independently of the particular operating parameters. High operation temperatures for example 150° C., and high pressures, for example 350 bars, exert no influence of any kind on the connection provided by the invention. Lastly, between the individual diaphragm layers, relative motion of any kind is also prevented so that no abrasion through friction occurs.

Figure 2:
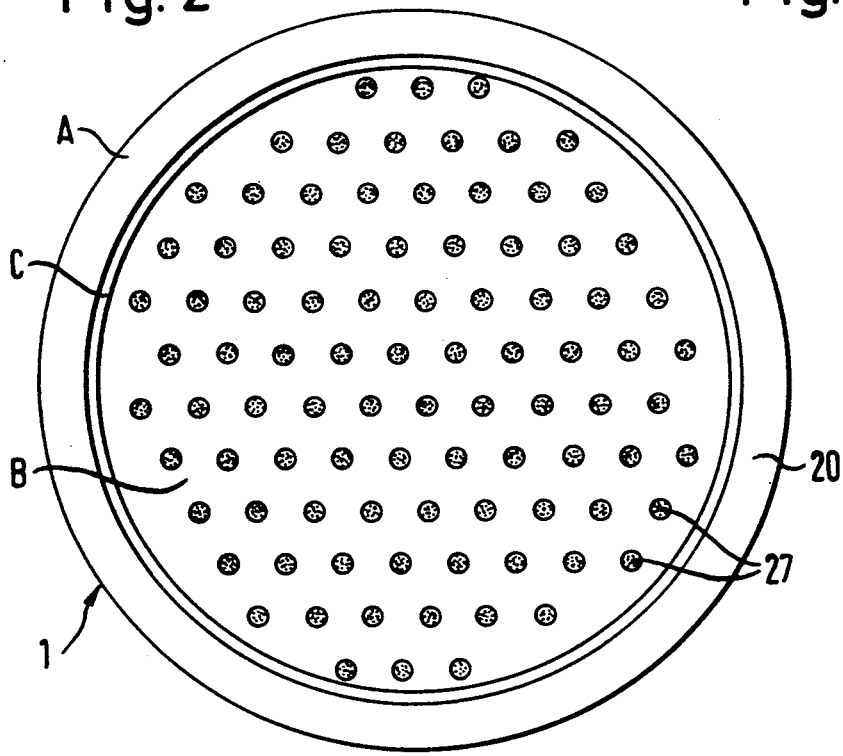
Figure 3:
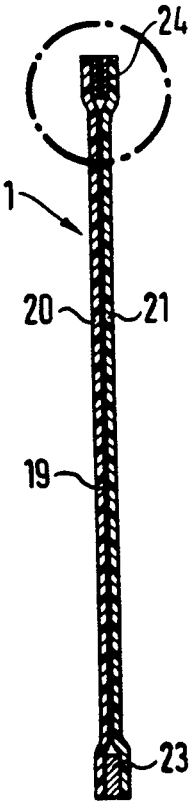
Figure 4:
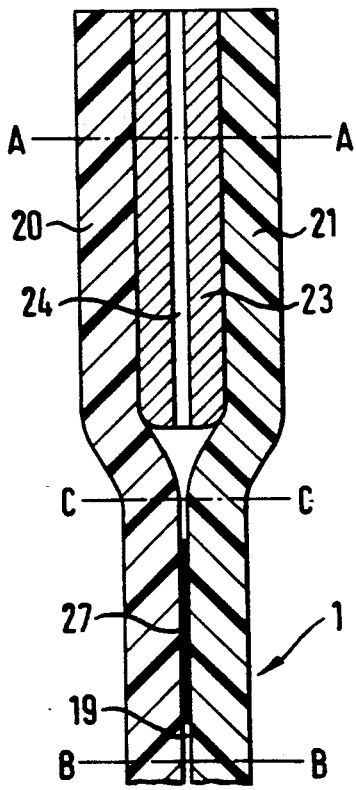
Figure 5:
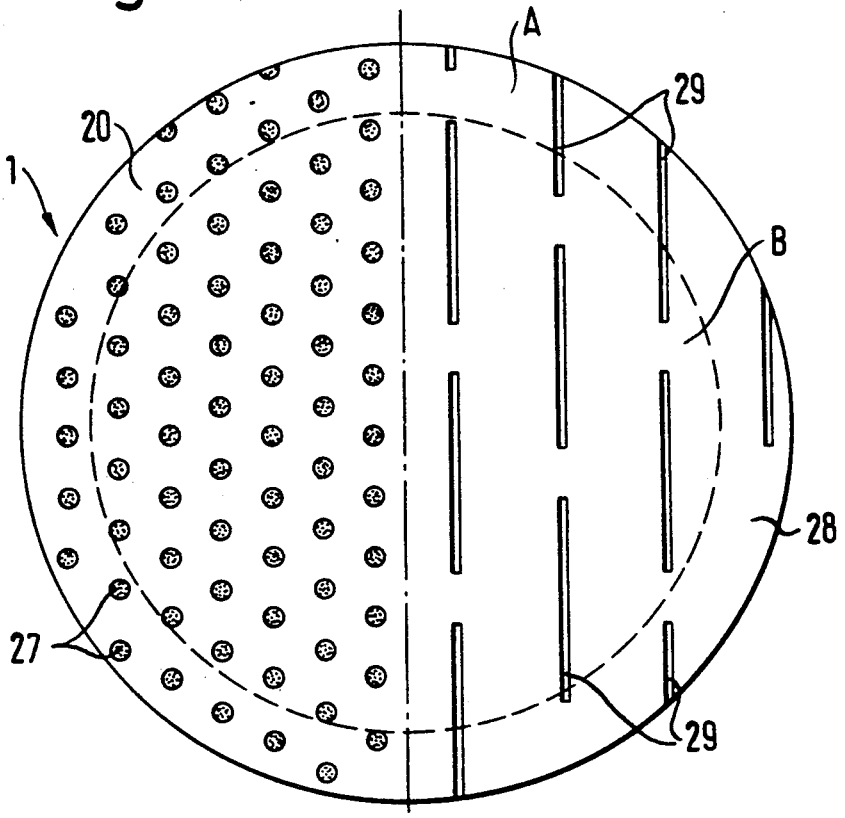
Figure 6:
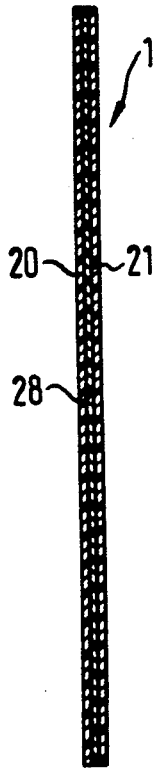
Figure 7:
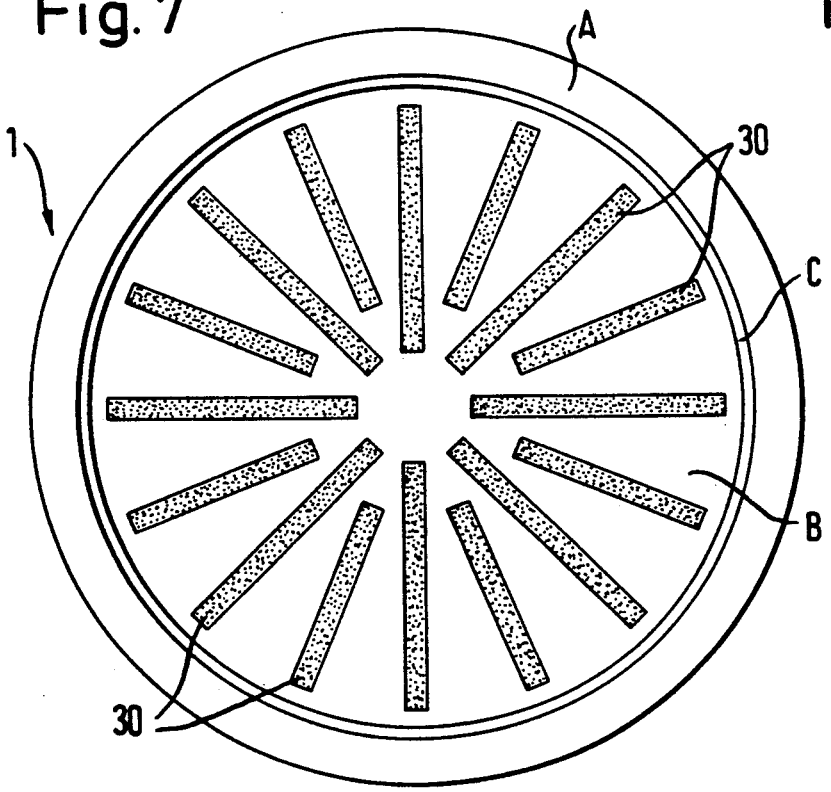
Figure 8:
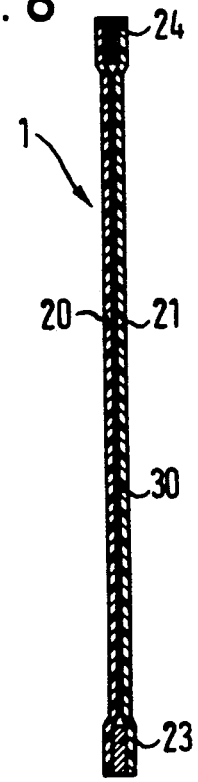
Figure 9:
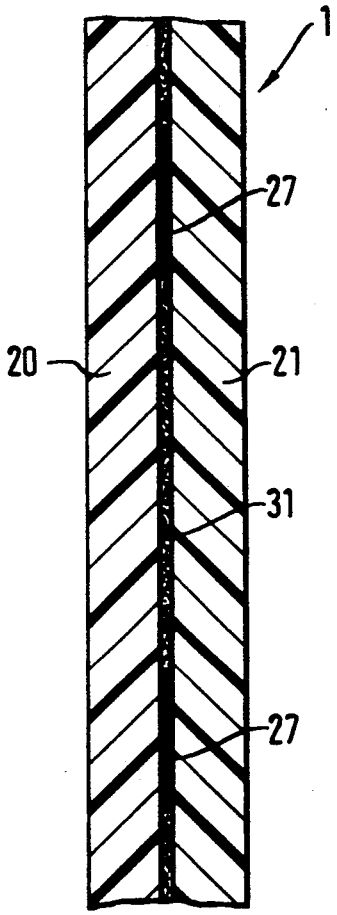

Referring now to the drawings:

FIG. 1 is a cross-section of an hydraulically driven diaphragm pump equipped with the diaphragm of the invention, FIG. 2 is the diaphragm of the invention schematically in top view and FIG. 3 is in cross-section thereof, FIG. 4 is a cross-section of the margin detail of the diaphragm of FIG. 3 on an enlarged scale, FIG. 5 is a modified embodiment of the diaphragm in a partially cut top view, and FIG. 6 is a cross-section thereof, FIG. 7 is a further modified embodiment of the diaphragm with the connecting areas implemented as connecting strips schematically in top view, and FIG. 8 is a cross-section thereof and FIG. 9 is a cross-section of a further modified embodiment of the diaphragm.

As can be seen in FIG. 1, the hydraulically driven diaphragm pump has a diaphragm 1 which will be further described which is provided with a margin clamp-in zone A at which it is clamped in between a pump housing 2 as well as a pump cover 3 detachably fastened on its front face. The diaphragm 1 separates a transport volume 4 from a pressure volume filled with an hydraulic fluid. The latter is connected via several housing-side axial bores 6 with an hydraulic volume 7. The diaphragm pump has an hydraulic diaphragm drive in the form of an oscillating displacement piston 8 which is displaceably sealed in the pump housing 2 between the hydraulic volume 7 and a supply volume 9 for the hydraulic fluid.

As can be seen, the pressure volume 5 is bounded, on the one hand, through the diaphragm 1 as well as, on the other hand, through a rearward piston-side concavity 10. The diaphragm 1 is in contact with this rearward boundary concavity 10 at the end of the intake stroke. The pump cover 3 in which is also formed a front boundary concavity 11, has in the customary manner an inlet valve 12 as well as an outlet valve 13. These two valves 12, 13 are connected via an inlet channel 14 as well as an outlet channel 15 with the transport volume 4 so that the transported medium in the intake stroke of the displacement piston 8 and consequently of the diaphragm taking place toward the right of FIG. 1 in the direction of the arrow via the inlet valve 12 and the inlet channel 14 is drawn into the transport volume 4. In the pressure stroke of the diaphragm taking place toward the left of FIG. 1, the transported medium is then pressed out so as to be apportioned from the transport volume 4 via the outlet channel 15 and the outlet valve 13 in the direction of the arrow.

To prevent an overloading of the diaphragm 1 at the end of the intake stroke as well as the occurrence of cavitation in the pump housing 2, a conventional spring-loaded blow valve 16 is provided which via channels 17, 18 is connected with one of the axial bores 6 or with the supply volume 9 and consequently—settably—at too great an intake stroke effect of the displacement piston 8 opens the connection between the supply volume 9 and the pressure volume 5 or the hydraulic volume 7.

In the embodiment, the diaphragm 1 is made as a two-layer diaphragm with two individual layers 20, 21 between which a diaphragm interspace 19 is formed. This diaphragm interspace 19 serves in the event of a rupture of one of the diaphragm layers 20, 21 for the rapid diaphragm rupture signaling and specifically by means of an appropriate indicator device 22 which is connected with the diaphragm interspace 19. For this purpose, the individual diaphragm layers 20, 21 are kept at a distance in their margin clamp-in zone A through an annulus 23 as is be clearly evident in FIG. 4. This annulus 23 is provided with one or several channels 24 which establish the connection between the diaphragm interspace 19 and the interior of the diaphragm rupture indicator device 22.

This indicator device 22 in the embodiment is made as a diaphragm pressure switch which responds as soon as rupture of one of the diaphragm layers 20, 21 occurs to the fluid pressure—either from the transport volume 4 or from the pressure volume 5—propagated into the diaphragm interspace 19 and from there to the diaphragm pressure switch 22. Through an appropriately connected acoustic indicator 25 and/or an optic display 26, the diaphragm rupture can subsequently be communicated.

As can be seen in detail in FIGS. 2, to 4, the individual layers 20, 21 of the diaphragm 1 are connected with each other through a multiplicity of connecting areas in the form of connecting points 27 with the formation of free areas or free spaces disposed between them so that during the pressure stroke as well as also during the intake stroke of the diaphragm, a purely mechanical coupling is present. These connecting points in the above manner are formed by welding together the diaphragm layers 20, 21 wherein the diaphragm for this purpose comprises suitable fluoropolymers in the manner described above. The connecting points 27 are disposed in a diaphragm area encompassed by the margin clamp-in zone A representing the active displacement zone B of the diaphragm 1 and connected by a flexure or transition zone C with the clamp-in zone A. Since this transition zone C is most strongly subject to load by the diaphragm motion, this area is advantageously not impaired at all through connecting points 27. Alternatively, the connecting points 27 disposed furthest toward the outside, as can be seen in FIG. 2, have a given minimum distance, for example 5–10 mm, relative to the transition zone C.

The connecting points 27 have a diameter of, for example 3–5 mm, and are largely uniformly distributed, and have the least possible distance from each other, for example 10–15 mm, wherein simultaneously, it must be ensured that the free spaces formed between the connecting points 27 form the diaphragm interspace 19.

In the modified embodiment of the diaphragm 1 of FIGS. 5 and 6, the outer diaphragm layers 20, 21 are mechanically connected with one another by the connecting points 27 through the disposition of an intermediate layer 28. In this embodiment which is especially suitable for low-pressure applications of the diaphragm pump, the intermediate layer 28 is produced of the material of the diaphragm layers 20, 21 and provided with slits 29 which extend, for example, in the manner seen in FIG. 5. These slits 29 have a length corresponding to at least the width of the clamp-in zone A. Consequently, the slits 29 provided in the intermediate layer 28 together with the free spaces formed between the connecting points 27 form channels which establish the connection from the active displacement zone B through the clamp-in zone A toward the outside, for example to the diaphragm rupture indicator device 22.

In this embodiment, the sandwich structure of the diaphragm 1 can be produced or achieved in relatively large dimensions as semi-finished products. The individual diaphragm layers 20, 21 as well as also the intermediate layer 28 can be produced through simple punching out so that overall a simple production is ensured.

In the further modified embodiment of FIGS. 7 and 8, the connecting areas are not in the shape of connecting points but rather are made as connecting strips 30 which in the represented manner extend radially and also effect during the pressure stroke as well as also during the intake stroke of the diaphragm 1, a purely mechanical coupling of the diaphragm layers 20, 21.

Lastly, as can be seen in the further modified embodiment of FIG. 9, the two diaphragm layers 20, 21 of the diaphragm 1 are also kept at a distance through an intermediate layer 31 which intermediate layer 31 comprises a separating woven fabric or a separating nonwoven fabric which with its interspaces forms a channel system between the diaphragm layers 20, 21. In the event of a diaphragm rupture, the fluid pressure can extremely rapidly propagate in the direction of the diaphragm rupture indicator device 22 so that the diaphragm rupture is also indicated extremely rapidly. As is shown, the diaphragm layers 20, 21 are connected with each other through the connecting points 27—in a manner similar to the embodiments according to FIGS. 2 or 5.

Various modifications of the diaphragm of the invention may be made without departing from the spirit or scope thereof and it is to be understood that the invention is intended to be limited only as defined in the appended claims.

What we claim is:

1. A diaphragm for an hydraulically driven diaphragm pump provided with a device for indicating diaphragm rupture wherein the diaphragm clamped at the margin between pump housing and pump cover comprises at least two individual layers which are only mechanically coupled during the pressure stroke and between which is formed a diaphragm interspace which is connected with the indicator device and in which, in the event of a rupture of one of the diaphragm layers, the fluid pressure penetrates and propagates diaphragm layers (20, 21) for the mechanical coupling also during the intake stroke are connected with each other through a multiplicity of connecting areas (27, 30) which are made as small as possible with the formation of interspaced free areas or free spaces, respectively, of maximum size.

2. A diaphragm of claim 1 wherein the diaphragm layers (20, 21) are made of a synthetic material and that the connecting layers (27, 30) are formed by welding together the diaphragm layers (20, 21).

3. A diaphragm of claim 2 wherein the synthetic material is a fluoropolymer.

4. A diaphragm of claim 1 wherein the connecting areas (27, 30) have the smallest possible distance between one another.

5. A diaphragm of claim 1 wherein the connecting areas (27, 30) are substantially uniformly distributed.

6. A diaphragm of claim 1 wherein the connecting areas are made as connecting points 27.

7. A diaphragm of claim 1 wherein the connecting areas are made of connecting strips (30) extending radially.

8. A diaphragm of claim 1 having at the margin a clamp-in zone (A), a displacement zone (B) actively effecting the transport, a transition zone (C) between clamping zone and displacement zone, wherein the connecting areas (27, 30) are disposed exclusively in the displacement zone (B) so that the displacement zone (B) of the diaphragm (1) has at the margin a connection-free encompassing region.

9. A diaphragm of claim 8 wherein the connection-free encompassing zone is of 5–10 mm width.

10. A diaphragm of claim 1 wherein the outer diaphragm layers (20, 21) through the arrangement of an intermediate layer (28, 31) are mechanically coupled with one another.

11. A diaphragm of claim 10 wherein the intermediate layer (28) is made of the same material as the outer diaphragm layers (20, 21) and is provided with slits (29) which form the diaphragm interspace together with the free spaces between the diaphragm layers (20, 21) connected with the indicator device (22).

12. A diaphragm of claim 10 wherein the intermediate layer (31) is a separating woven fabric or a separating nonwoven fabric.

* * * * *